US006840834B2

(12) United States Patent
Schueller et al.

(10) Patent No.: US 6,840,834 B2
(45) Date of Patent: Jan. 11, 2005

(54) PACKAGE STRUCTURE FOR MOUNTING A FIELD EMITTING DEVICE IN AN ELECTRON GUN

(75) Inventors: Randolph D. Schueller, Austin, TX (US); Kent R. Kalar, Austin, TX (US); Anthony A. Kloba, Austin, TX (US)

(73) Assignee: Trepton Research Group, Inc., Santa Clara, CA (US)

( * ) Notice: Subject to any disclaimer, the term of this patent is extended or adjusted under 35 U.S.C. 154(b) by 100 days.

(21) Appl. No.: 10/269,172

(22) Filed: Oct. 11, 2002

(65) Prior Publication Data

US 2003/0032362 A1 Feb. 13, 2003

Related U.S. Application Data

(62) Division of application No. 09/493,379, filed on Jan. 28, 2000, now Pat. No. 6,469,433.

(51) Int. Cl.[7] ..... H01J 9/12
(52) U.S. Cl. ..... 445/36; 445/67
(58) Field of Search ..... 445/67, 3, 4, 34, 445/36; 313/414, 417, 446, 447

(56) References Cited

U.S. PATENT DOCUMENTS 4,414,485 A * 11/1983 Marschka ..... 313/451
5,869,924 A 2/1999 Kim ..... 313/446
5,898,262 A 4/1999 Kim et al. ..... 313/446
5,905,332 A 5/1999 Yun et al. ..... 313/414

OTHER PUBLICATIONS

D.E. Patterson, et al., "Advanced CVD Diamond Microtip Device for Extreme Applications", *Mat. Res. Soc. Symp. Proc.* vol. 509 (1998) pp. 65–75. no month.

* cited by examiner

*Primary Examiner*—Joseph Williams
(74) *Attorney, Agent, or Firm*—Martine & Penilla LLP

(57) ABSTRACT

Apparatus and method are provided for a package structure that enables mounting of a field-emitting cathode into an electron gun. A non-conducting substrate has the cathode attached and the cathode is electrically connected to a pin through the substrate. Other pins are electrically connected to electrodes integral with the cathode. Three cathodes may be mounted on a die flag region to form an electron gun suitable for color CRTs. Accurate alignment of an emitter array to the apertures in the electron gun and other electrodes such as a focusing lens is achieved. The single package design may be used for many gun sizes. Assembly and attachment of the emitter array to the electron gun during construction of the gun can lower cost of construction.

7 Claims, 9 Drawing Sheets

PACKAGE STRUCTURE FOR MOUNTING A FIELD EMITTING DEVICE IN AN ELECTRON GUN

RELATED REFERENCES

This application is a divisional of application Ser. No. 09/493,379, filed Jan. 28, 2000 now U.S. Pat. No. 6,469,433.

BACKGROUND OF THE INVENTION

1. Field of the Invention

This invention pertains to electron guns for devices such as cathode ray tubes (CRTs). More particularly, a package structure for mounting a field-emitting device into an electron gun is provided.

2. Description of Related Art

A cathode ray tube (CRT) and other devices requiring an electron beam normally include an electron gun having a thermionic emitter as the cathode. The electron gun is assembled to include the cathode and other electrodes that focus and accelerate the electron beam. Such electron guns are typically assembled manually and the cathode is inserted after the gun is assembled. Such assembly can be costly. It would be an advantage to include the cathode portion of the gun in the initial assembly.

The technology to allow replacement of cathodes based on thermionic emission with cold cathodes based on field emission of electrons has been developing in recent years. The field emission of electrons occurs from microtips that are fabricated from molybdenum, silicon or, in very recent years, carbon-based materials. It has been demonstrated that the carbon-based material or diamond-like material can be monolithically integrated with gated electrodes in a self-aligned structure, using integrated circuit fabrication techniques ("Advanced CVD Diamond Microtip Devices for Extreme Applications," MAT. RES. SOC. SYMP. PROC., Vol. 509 (1998)). The use of field emission devices with the extraction gate built-in eliminates the need for two of the electrodes in an electron gun built on thermionic emission. Elimination of these components simplifies the gun and also reduces its length. The application of the integrated carbon-like cathode and electrodes into an electron gun has been described in pending and commonly assigned patent application entitled "Compact Field Emission Electron Gun and Focus Lens," filed Jul. 19, 1999, Ser. No. 09/356,851, with named inventors Rich Gorski and Keith D. Jamison, which is incorporated herein by reference.

Devices heretofore known for assembling cathode structures and electron guns using field emission cathodes are described in U.S. Pat. No. 5,898,262. This patent describes a way for packaging a field-emitting device to construct a color cathode ray tube. An insulating piece with an indentation for a single field emitting device that has three emission areas is provided. U.S. Pat. No. 5,869,924 provides an insulating material (plastic) that is created by filling in an external case, with pins extending through the insulating material. The cathode device is wire-bonded directly to the head of the pins. U.S. Pat. No. 5,905,332 discloses additional portions of an electron gun beyond the field-emitting cathode itself. The aperture spacing in the focusing portion of the gun is larger than the spacing between the field emitting devices.

The cathode, accelerating and focusing elements of electron guns may be assembled by alignment with a centering tool, spaced apart with shims and held in place by a nonconductive ceramic that is sintered onto the outer edge of the elements. This sintering of the elements to a ceramic structure is called a "glass beading operation." The shim spacers are then removed to provide the electrically isolated elements of the electron gun. When thermionic emitters are used, a barium coated cathode is separately placed into the gun after this assembly operation. This is necessary because the fragile barium coating is not able to withstand the high temperatures at atmospheric pressure required in the glass beading operation.

One of the advantages of a field emission electron source is that the robustness of the cathode can allow the electron gun to be fully assembled before the glass beading operation. This eliminates the secondary step of inserting the thermionic component after the gun is assembled. A packaging technique is needed that takes advantage of the fact that the field-emission cathode can be placed at high temperature at atmospheric pressure without damage. The packaging should lower assembly costs of electron guns based on field emission cathodes. The package must also be constructed to allow precise alignment of the cathode in the electron gun. The structure resulting also should allow the use of the electron gun in a wide range of CRT neck-diameters.

BRIEF SUMMARY OF THE INVENTION

An electron gun cathode assembly having a field-emitting cathode and a method for assembling are provided. The field-emitting cathode may be carbon-based. A non-conductive substrate, normally a ceramic material in the form of a disk, has electrical connection such as provided by a die region to the back of a field-emitter die. An emitting array has been grown on the die by known methods. Three field-emitting dies may be spaced on the substrate to form an electron gun for a color CRT. Electrical connections for the die and for electrodes integral with the cathode are made to conductive traces that are connected to pins that pass through the substrate. A disk or can having one or more apertures is spaced apart from the emitting array by a separate spacer ring or the spacing may be created by forming the disk or can. Normally the substrate, spacer and disk or can are joined by welding or brazing, by adhesive or mechanically. The cathode assembly, including the disk or can and spacer, can be aligned and also aligned with a separate focusing electrode with an aligning tool that fits in apertures in the disk or can and lens. The entire assembly can then be glass beaded using known techniques.

DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1A:
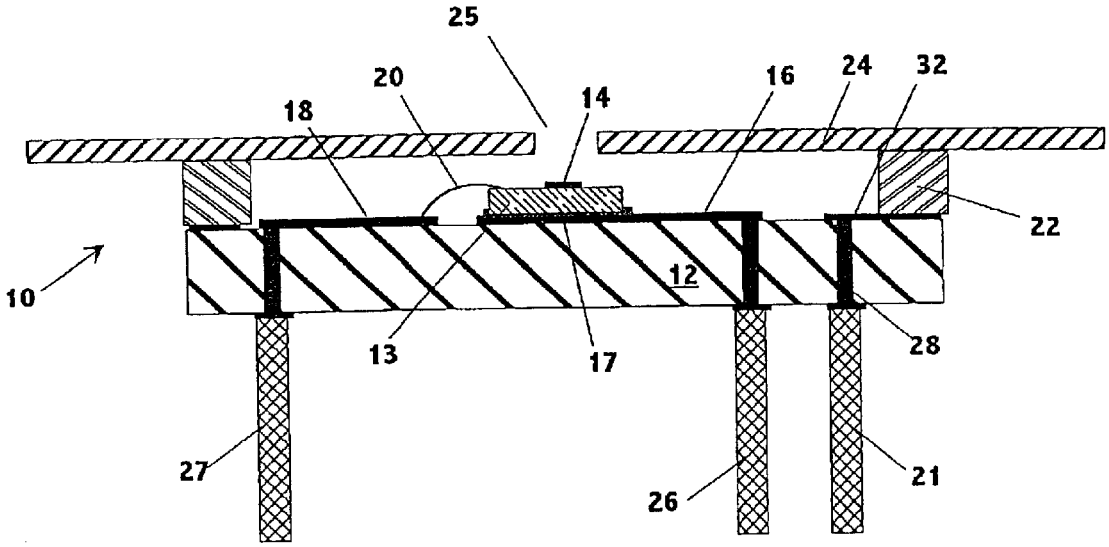
FIG. 1*a* shows a cross-section view of one embodiment of a cathode structure for an electron gun.

Referring to FIG. 1*a*, one embodiment of an electron gun cathode assembly is generally shown at 10. Ceramic substrate 12 supports a field emitting device, which includes die 13 on which field emitting array 14 has been formed. Array 14 has been formed using methods for forming field emitting arrays such as disclosed in Ser. No. 09/169,909, filed Oct. 12, 1998 and commonly assigned, or Ser. No. 09/169,908, filed Oct. 12, 1998, and commonly assigned, or other field emitting devices which are known in the art and disclosed, for example in U.S. Pat. No. 5,869,924, all of which are incorporated by reference herein. Die 13 may be accurately placed on substrate 12 at a selected position using fiducials. Electrical connector 16, which may be a conductive trace made by well known techniques, connects field emitting die 13 to pin 26. High-temperature adhesive layer 17 enables a conductive path to the backside of die 13. The adhesive used to form adhesive layer 17 may be, for example, Ablebond 71-1 or Ablebond 2106. Conductive trace 18 connects to a bond pad to which wire 20 is attached. Wire 20 connects to an extraction electrode in emitting array 14. Array 14 may also include focus electrodes integrally formed in the array, as disclosed in the applications and patents cited above in this paragraph. The electrodes may be electrically connected to conductive pads on ceramic substrate 12 using a wire bonding process well known in industry. Ring 22 is a spacer between alignment disk 24 and ceramic substrate 12 Ring 22 may be metal or ceramic. The thickness of ring 22 is selected to place aperture 25 in disk 24 at a distance from array 14 so as to focus an electron beam emanating from array 14 by applying a selected voltage to disk 24. This distance is generally in the range from about 0.1 mm to about 10 mm. The aperture 25 in disk 24 is aligned with array 14 and disk 24 may be attached to the ring 22 through a weld or braze. Ring 22 may be attached to ceramic substrate 12 by brazing to metallized trace 32 on substrate 12. Metallized trace 32 is electrically connected to pin 21 through via 28. Alignment disk 24 is extremely important since it primarily is used for insuring that field emitting array 14 is properly centered with other elements of an electron gun. The outer edge of the alignment disk is used for mounting the cathode in an electron gun, as discussed below. Electrical connection to disk 24 through pin 21 allows disk 24 to be used as a focus lens in an electron gun. The diameter of alignment disk 24 may be sized for placement in a wide range of sizes of CRTs or other devices. Disk 24 is typically formed from stainless steel. Conductive trace 16 is connected to pin 28. Pins such as 26 and 28 may be formed from iron or copper-based alloys, for example. Contact wires (not shown) may be spot welded to the pins during the final stemming operation. The wires provide electrical connection outside of the CRT.

Figure 1B:
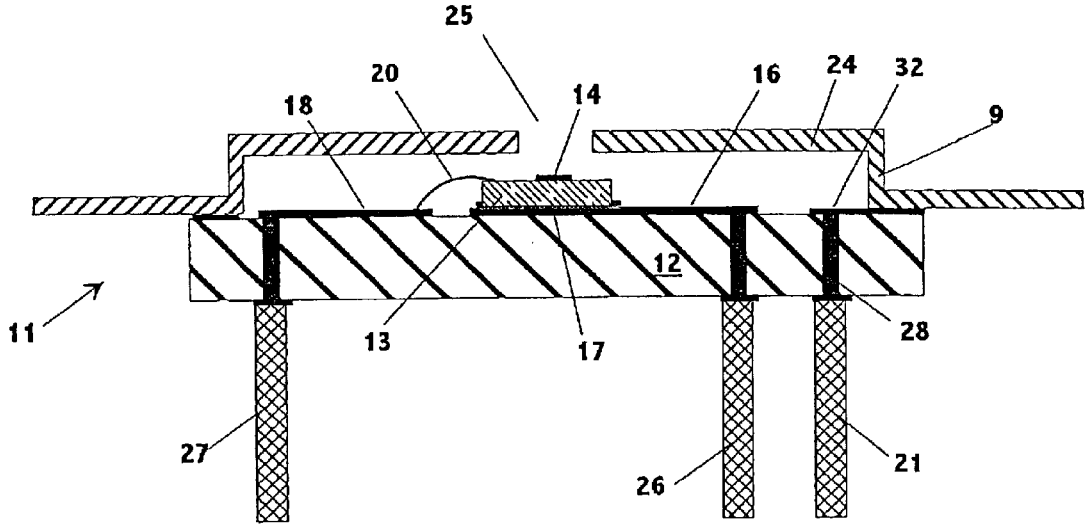
FIG. 1*b* shows a cross-section view of a second embodiment of a cathode structure for an electron gun.

A second embodiment of an electron gun cathode assembly is shown generally at 11 in FIG. 1*b*. This embodiment is similar to that in FIG. 1*a*, with the spacing ring 22 removed. In this embodiment, the alignment disk is formed with cylindrical side 9 to enable the required spacing between the alignment disk and field emitting die. The alignment disk may be mechanically and electrically attached to metallized trace 32 on the substrate with either a weld or an adhesive bond. Metallized trace 32 is electrically connected to pin 21. This embodiment may be more cost-efficient since it eliminates the need to manufacture spacing ring 22.

Figure 1C:
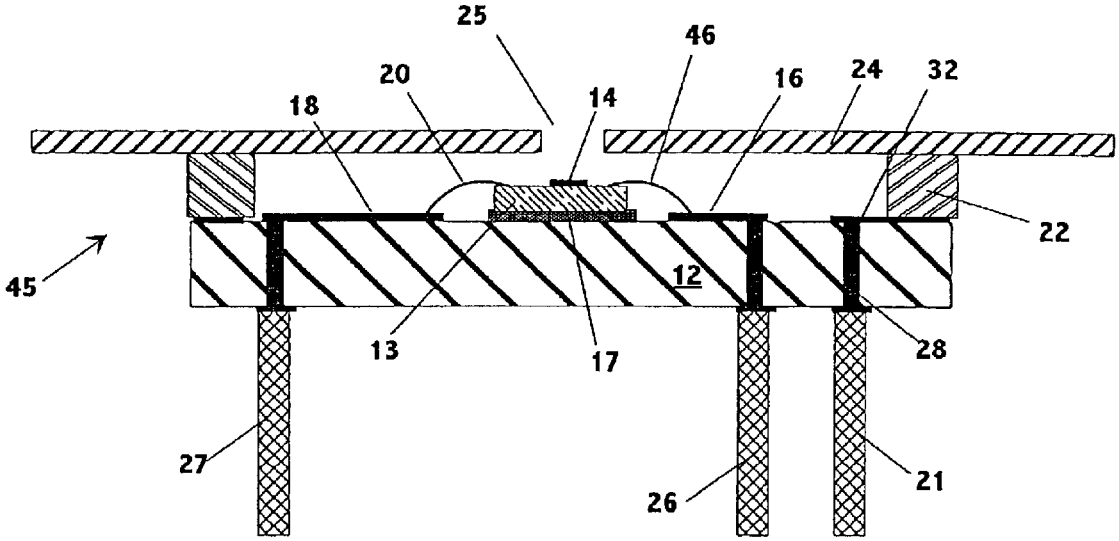
FIG. 1*c* shows a cross-section view of a third embodiment of a cathode structure for an electron gun.

A third embodiment of an electron gun cathode assembly is shown generally at 45 in FIG. 1*c*. This embodiment is similar to 1*a*, however it instead allows for a cathode connection to die 13 through wire 46 to metallized trace 16 that is connected to pin 26. This is the preferred embodiment in those instances in which the backside of die 13 is not conductive.

Figure 2:
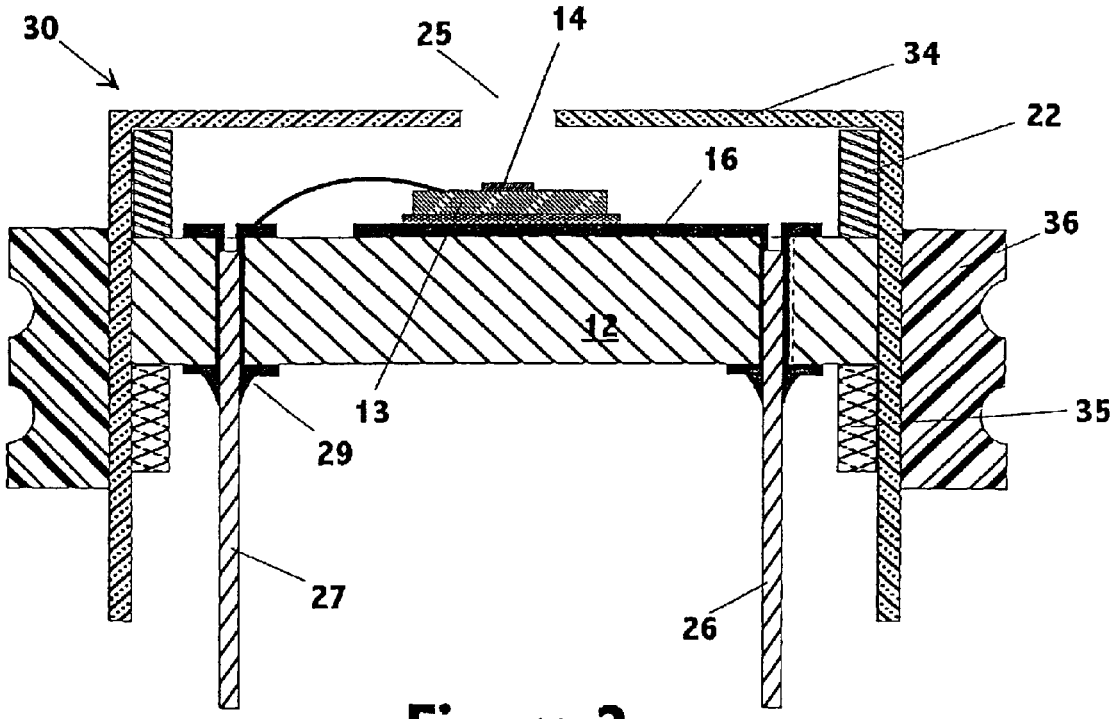
FIG. 2 shows a cross-section view of a fourth embodiment of a cathode structure for an electron gun.

A fourth embodiment of an electron gun cathode assembly is shown generally at 30 in FIG. 2. In this embodiment, cylinder-shaped can 34 having wings 36 is used for insuring that field emitting array 14 is properly centered with other elements of an electron gun and for mounting the cathode in an electron gun. The diameter of can 34 or the dimensions of wings 36 may be selected to allow placement of assembly 30 in a wide range of sizes of CRTs or other devices. Ring 22 is inserted in can 34 and acts as a spacer to provide the optimal separation between emitting array 14 and aperture 25 in can 34. Ring 35 is inserted after the cathode assembly and is used to lock the cathode in place. Braze 29 may be used to fasten pins into ceramic substrate 12. Can 24 is typically formed of stainless steel. One advantage of the cylinder-shape can is that easier mechanical alignment is attained by tightly fitting substrate 12 into the opening in can 34. Another advantage is that this package assembly allows the additional option of glass bead attaching the can 34 to the other elements of the electron gun prior to insertion of the cathode assembly.

Figure 3:
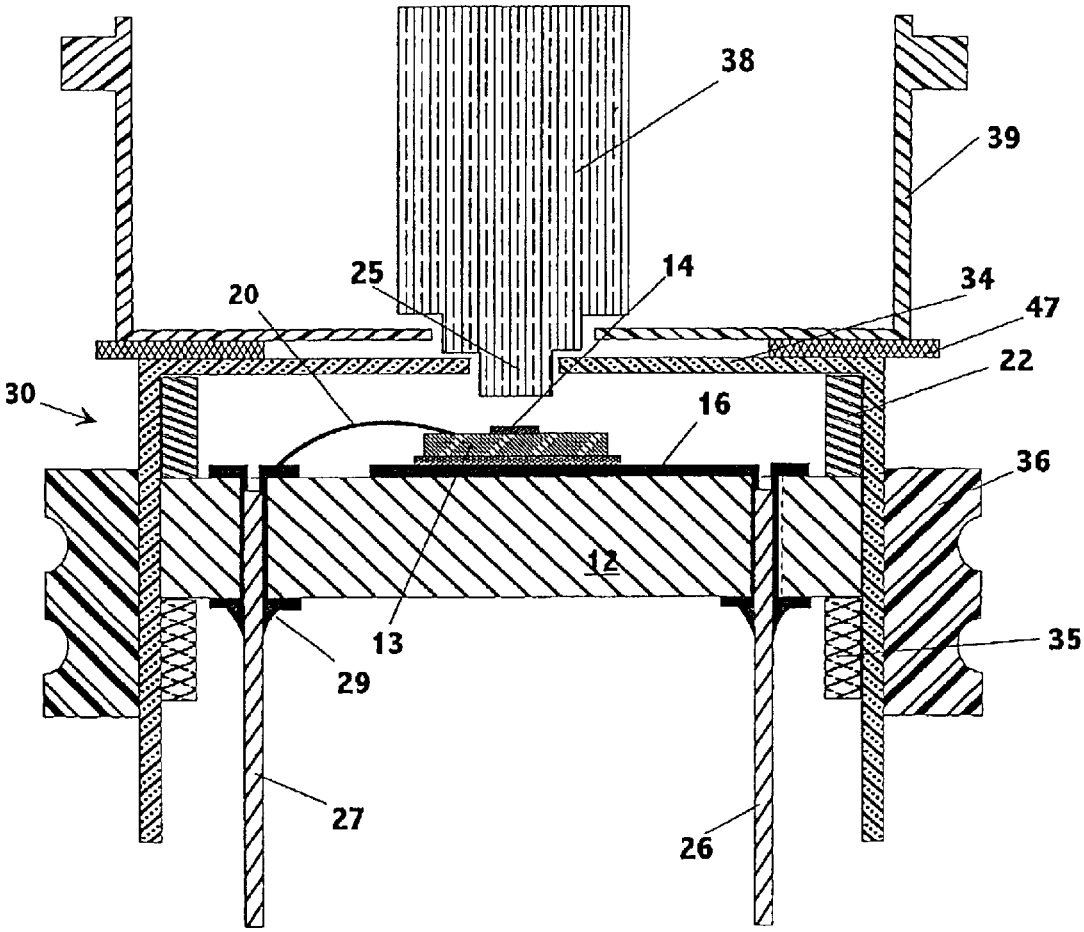
FIG. 3 shows an aligning tool being used for alignment of a cathode structure and an electrode.
Figure 4:
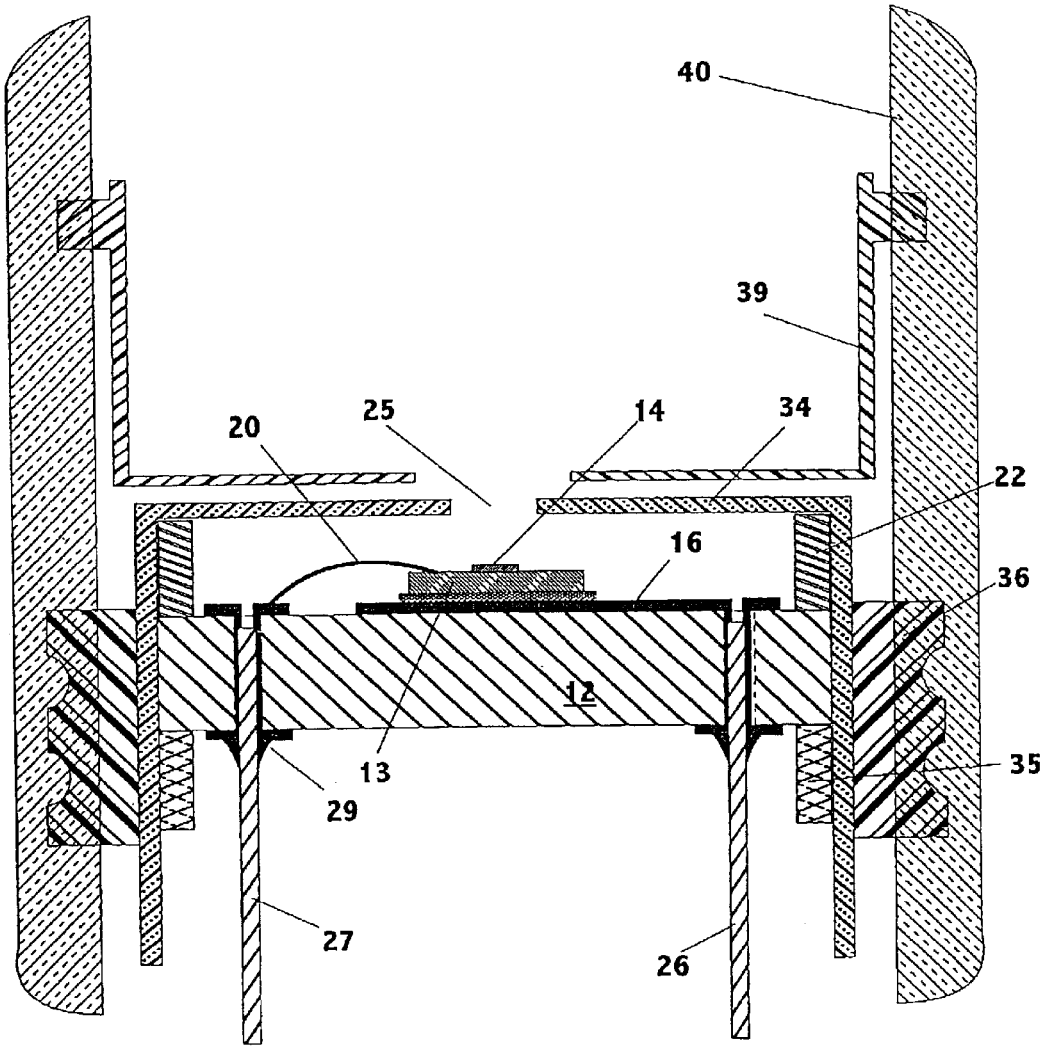
FIG. 4 shows glass beading of a cathode structure and an electrode.

FIGS. 3 and 4 show how electron gun cathode assembly 30 may be aligned with other electrodes in a CRT or other device and glass beaded into place (cathode assemblies 10, 11, and 45 would be assembled in similar manner). Aligning tool 38, sized to fit into aperture 25 of gun 30 and into the aperture of focusing lens 39 or any other grids to be placed in the device, is placed in the apertures and aligned along the axis of the device. Spacing between the gun elements may be achieved with the use of temporary shims 47 that are later removed. Gun 30 and other lenses or grids are then fixed in place using ceramic 40 (FIG. 4). Aligning tool 38 and shim 47 are then removed. Alternatively, gun 10 or 11, for example, may be assembled in place of gun 30 using the same procedure.

Figure 5:
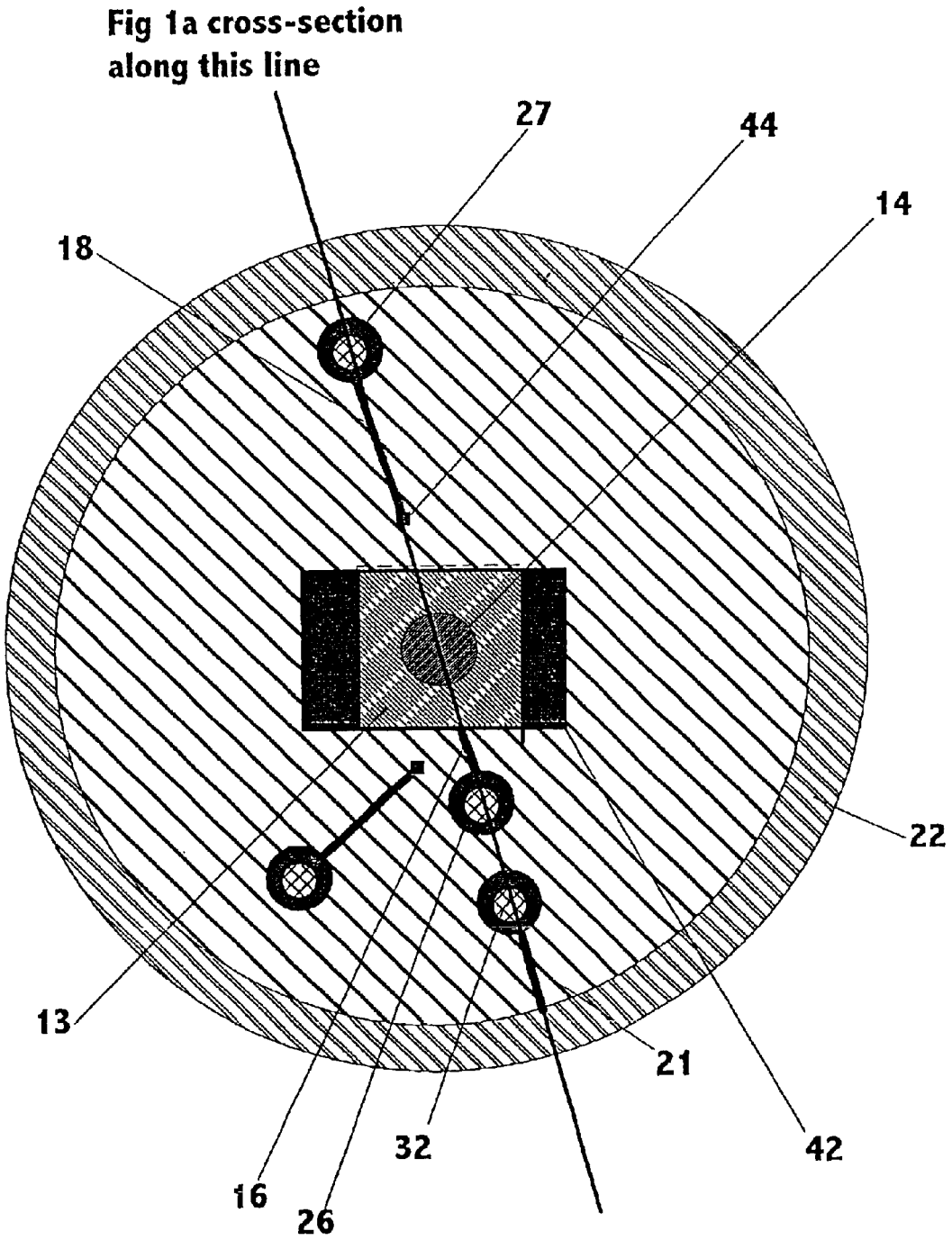
FIG. 5 shows a top view of the single cathode and electrical connections on a substrate that is shown in cross-section in FIG. 1*a*, but with the top disk removed.

Referring to FIG. 5, a top view is shown of the cathode assembly shown in cross-section in FIG. 1*a* but with disk 24 removed. Ceramic substrate 12, field emitting die 13 and field emitting array 14 are shown from the top. Field emitting die 13 is bonded to die flag region 42 with conductive cement, as disclosed above. The electrically conductive adhesive enables a conductive path to the back side of field emitting array 14. Die flag region 42 may be formed on ceramic substrate 12 by a metal, typically tungsten, although copper or other metals would be satisfactory. The metal is typically screened on and fired with the ceramic. The ceramic is typically aluminum oxide, although other ceramics would be satisfactory. Such ceramic substrates are available from Kyocera, Coors or other suppliers. Wire bond pads 44 provide a terminal for fixing wire bond connections between elements of the electron gun and pins such as 26 and 27. Wire leads such as 20 of FIG. 1 are typically joined to wire bond pads by thermosonic bonding, using techniques well known in industry. If in integral focus electrode is present in array 14 a separate wire lead is connected to the focus electrode and to a pad such as 44. Conductive traces such as 16 and 18 electrically connect pins to various components of the electron gun or to the die flag region. Spacer ring 22 was discussed above. It may be formed from KOVAR, a steel alloy or may be eliminated and the alignment plate formed to create the required spacing as in FIG. 1*b*. A single field emission array is illustrated in FIG. 5, which would be used in a CRT for a monochrome gun.

Figure 6:
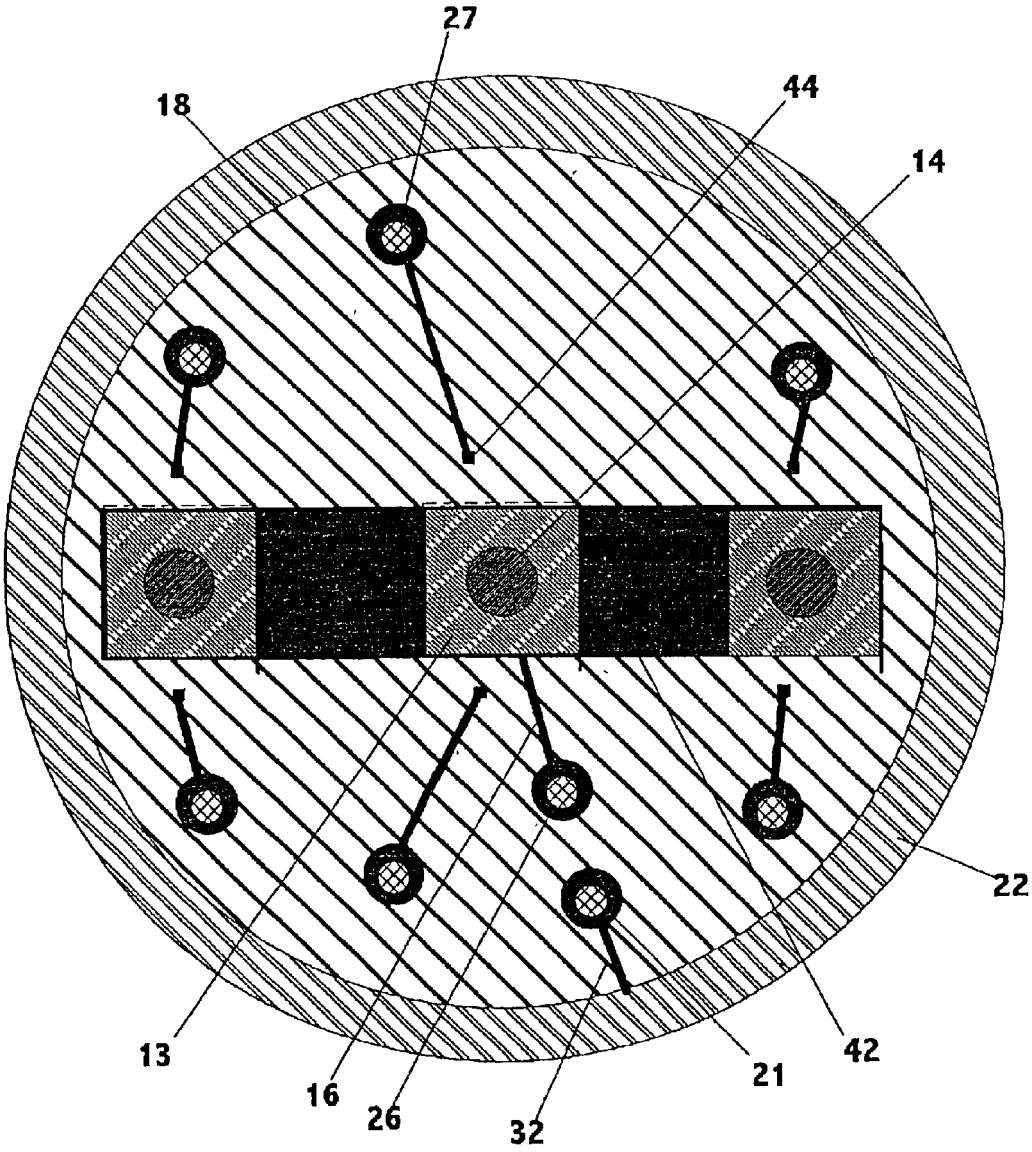
FIG. 6 shows a top view of three cathodes and electrical connections on a substrate.

FIG. 6 illustrates one embodiment of an assembly of three emission arrays to be used in an electron gun to be placed in a color CRT. In this case, one die is needed for red, one for green, and one for blue. All three dies 14 are mounted on die flag region 42. Additional pins will be connected through conductive traces such as 18 to wire bond pads such as 44. Die flag region 42 is used for connecting through field emission dies as described above. With three emission areas, a disk such as disk 24 of FIG. 1*a* or a can such as can 34 of FIG. 2 would have three openings, each to be placed opposite arrays 14. The disk or can may then be fixed to ring 22.

Figure 7:
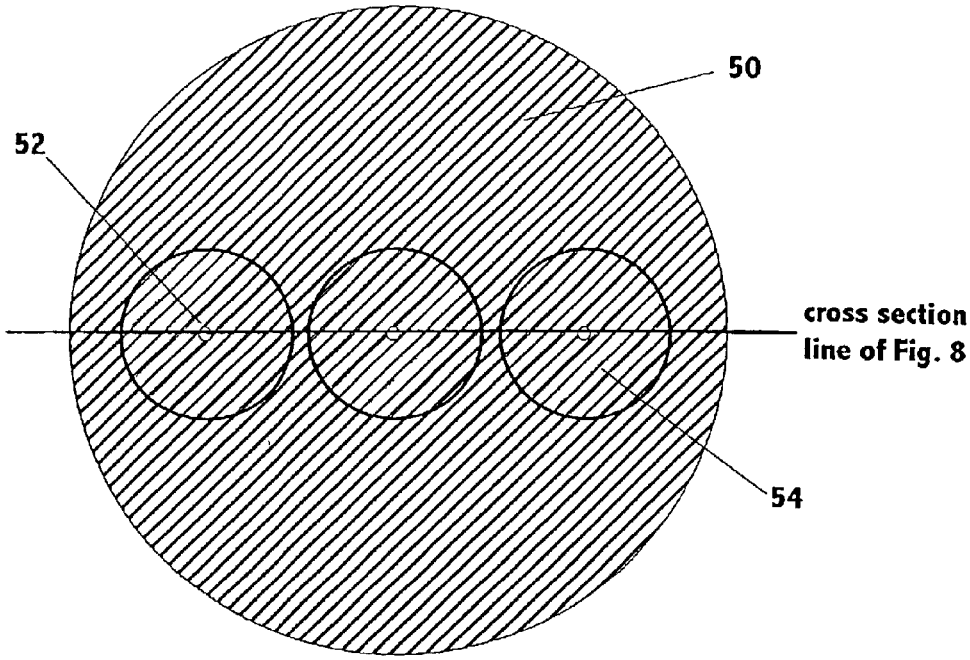
FIG. 7 shows a top view of one embodiment of an alignment disk for a three-cathode structure.
Figure 8:
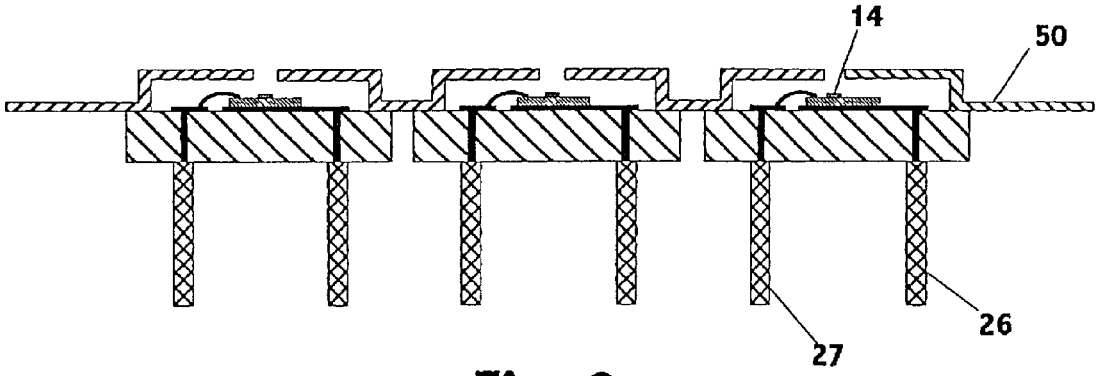
FIG. 8 shows a cross-section view of one embodiment of the three-cathode structure shown in FIG. 7.

Referring to FIG. 7, alignment disk 50 to be used in another embodiment of a packaging device including three emission arrays is illustrated. Disk 50 serves the same purpose as alignment disk 24 of FIG. 1*a* or FIG. 1*b*. The disc includes three apertures 52. Also shown are three formed impression areas 54 that may be used to provide the correct spacing of the aperture to the field emitting array 14 of FIG. 6. Each cathode assembly, including field emitting array 14 would be centered under aperture 52. Alternatively, the impression areas may not be present and ring 22 of FIG. 5 may be joined by welding or cementing to alignment disk 50. A side view of the same assembly is shown in FIG. 8. Disk 50 may be glass beaded into an electron gun package using techniques described above whereby at least one aperture in the disk may be used for alignment.

The foregoing disclosure and description of the invention are illustrative and explanatory thereof, and various changes in the details of the illustrated apparatus and construction and method of operation and assembly may be made without departing from the spirit of the invention.

What we claim is:

1. A method for making a field-emitting cathode assembly, comprising:

providing a non-conductive substrate, the substrate having a first and a second surface, and a first conductive pin electrically connected to the first surfaced and extending from the second surface providing a field-emitting device having an emitting array and attaching the device to the first surface and electrically connecting the device to the first conductive pin;

electrically connecting at least one electrode of the field-emitting device to a second conductive pin, the second conductive pin extending from the second surface;

providing an alignment member having a least one aperture therein and a selected diameter;

providing a spacer to place the alignment member at a selected distance from the substrate; and joining the substrate and alignment member at a selected spaced-apart distance.

2. The method of claim 1 wherein the method of joining is selected from the methods of welding, brazing and applying adhesive.

3. The method of claim 1 wherein the alignment member is a disk and the disk further comprises a cylindrical side therein.

4. The method of claim 1 wherein the alignment member is a can.

5. A method for assembling an electron gun, comprising:

providing a field-emitting cathode assembly having an alignment member, the alignment member having at least one aperture having a first diameter;

providing a lens to be a part of the electron gun, the lens having an aperture having a second diameter, wherein the first diameter is equal to or less than the second diameter;

providing an aligning tool adapted to fit in the aperture of the alignment member and the lens; and placing the aligning tool in the apertures of the alignment member and the lens so as to align the apertures and placing a shim between the alignment member and the lens so as to provide a selected distance therebetween; and glass beading the field-emitting cathode assembly and the lens.

6. The method of claim 5 wherein the alignment member is a can, the can further comprising wings attached thereto produce the first diameter.

7. The method of claim 5 wherein the aperture of the alignment member and the aperture of the lens are substantially centered within the alignment member and the lens, resepectively.

* * * * *